US008375867B2

(12) United States Patent
Baranowski et al.

(10) Patent No.: US 8,375,867 B2
(45) **Date of Patent: *Feb. 19, 2013**

(54) RAILCAR COVER OPENING/CLOSING SYSTEM

(75) Inventors: Kenneth M. Baranowski, Albion, IN (US); Arturo Machado, Elkhart, IN (US); Roy J. Huber, Goshen, IN (US)

(73) Assignee: United Railcar Covers LLC, Ligonier, IN (US)

( * ) Notice: Subject to any disclaimer, the term of this patent is extended or adjusted under 35 U.S.C. 154(b) by 182 days.

This patent is subject to a terminal disclaimer.

(21) Appl. No.: 12/876,797

(22) Filed: Sep. 7, 2010

(65) Prior Publication Data

US 2010/0326318 A1 Dec. 30, 2010

Related U.S. Application Data

(63) Continuation-in-part of application No. 12/269,153, filed on Nov. 12, 2008, now Pat. No. 8,051,779.

(60) Provisional application No. 61/038,474, filed on Mar. 21, 2008.

(51) Int. Cl.
*B61D 39/00* (2006.01)

(52) U.S. Cl. ..... 105/377.09

(58) Field of Classification Search ..... 105/377.01, 105/377.06, 377.09, 377.11; 296/100.01, 296/100.02–100.05; 414/373, 390, 402
See application file for complete search history.

(56) References Cited

U.S. PATENT DOCUMENTS

| | | | | |
|---|---|---|---|---|
| 3,628,828 | A * | 12/1971 | Page et al. | 49/381 |
| 3,831,792 | A * | 8/1974 | Waterman et al. | 414/373 |
| 4,524,700 | A * | 6/1985 | Engdahl | 105/377.09 |
| 6,092,471 | A * | 7/2000 | Early | 105/377.07 |
| 7,878,124 | B2 * | 2/2011 | Low et al. | 105/377.05 |

* cited by examiner

*Primary Examiner* — S. Joseph Morano
*Assistant Examiner* — Zachary Kuhfuss
(74) *Attorney, Agent, or Firm* — Taylor IP, P.C.

(57) ABSTRACT

A cover opening and closing system for use with a railcar. The railcar has a longitudinal axis, a top opening and at least one movable cover configured to cover the opening. The cover opening and closing system includes at least one structural support coupled generally to the ground and at least one of an opening device and a closing device. The opening device and closing device are coupled to said at least one structural support. The at least one of an opening device and a closing device are configured to contact a portion of the at least one movable cover and to cause the movable cover to move as the railcar moves in a longitudinal direction substantially parallel with the longitudinal axis.

16 Claims, 9 Drawing Sheets

RAILCAR COVER OPENING/CLOSING SYSTEM

This is a continuation-in-part of U.S. patent application Ser. No. 12/269,153, entitled "RAILCAR COVER", filed Nov. 12, 2008 now U.S. Pat. No. 8,051,779, which is a non-provisional application based upon U.S. provisional patent application Ser. No. 61/038,474, entitled "RAILCAR COVER", filed Mar. 21, 2008, both of which are incorporated herein by reference.

BACKGROUND OF THE INVENTION

1. Field of the Invention

The present invention relates to a cover system for a railcar, and, more particularly, to an opening and closing system for railcar covers.

2. Description of the Related Art

Bulk carrying railcars often have openings along the top that are opened for the loading of material and closed for transportation, some bulk railroad cars are utilized without any cover. It is desirous to protect the materials carried in the interior of the railroad car from damage, which may be caused by weather or other environmental sources of damage which may include particulate or biologic material contained in the area. It is also desirous to prevent the bulk material from being dissipated by transportation due to the air billowing over the bulk material while it is in transit. It is desirable to have a railcar open on top so as to provide an easy way of loading cargo from a delivering device, such as a hopper, that may be suspended over the top of the railroad car. It is known to have railroad car hatches that are hinged and which are opened by releasing the latches on one side and pivoting the covers to the other side thereby exposing a portion of the top of the railroad car so that material may be loaded therein. It is known to have sliding cover doors that employ rolling bearings located at each end of the railcar. This type of device requires a system that can coordinate the rolling, which can lead to mechanism failure such as the covers becoming pinched preventing their smooth operation. This system also requires personnel to operate the mechanism.

What is needed in the art is a railcar cover system that can easily and repeatably slide open a cover to expose the top of the railroad car and closed to cover the material therein.

SUMMARY OF THE INVENTION

The present invention is directed to a railcar cover opening/closing system with linear bearings associated with the movable hatch.

The present invention consists in one form thereof of a cover opening and closing system for use with a railcar. The railcar has a longitudinal axis, a top opening and at least one movable cover configured to cover the opening. The cover opening and closing system includes at least one structural support coupled generally to the ground and at least one of an opening device and a closing device. The opening device and closing device are coupled to said at least one structural support. The at least one of an opening device and a closing device are configured to contact a portion of the at least one movable cover and to cause the movable cover to move as the railcar moves in a longitudinal direction substantially parallel with the longitudinal axis.

An advantage of the present invention is that the linear bearing devices are coact with the opening and closing devices to move the covers in a substantially coordinated manner.

Another advantage of the present invention is that the opening and closing devices open and close the cover without the need for human intervention.

Yet another advantage of the present invention is that the opening and closing devices are self-centering providing a coordinated opening and closing of the railcar cover hatches.

Yet another advantage of the present invention is that the opening and closing of the railcar cover occurs by the movement of the railcar under the opening and closing devices.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrates one embodiment of the invention, in one form, and such exemplification is not to be construed as limiting the scope of the invention in any manner.

DETAILED DESCRIPTION OF THE INVENTION

Figure 1:
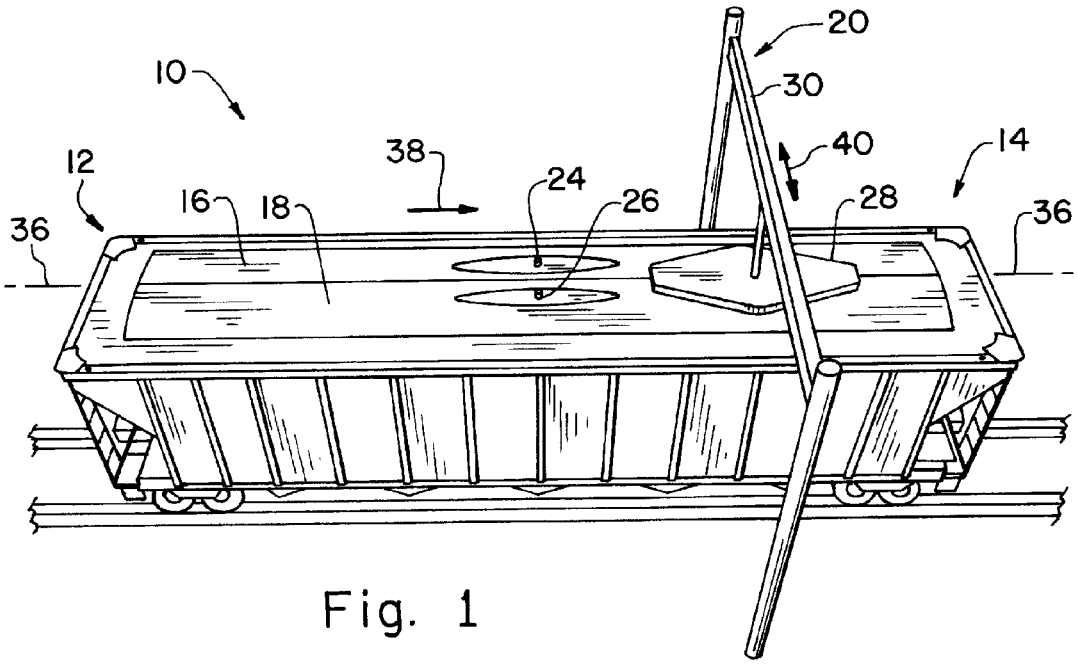
FIG. 1 is a perspective view of a railcar having an embodiment of a railcar cover of the present invention with an opening device suspended thereover.
Figure 2:
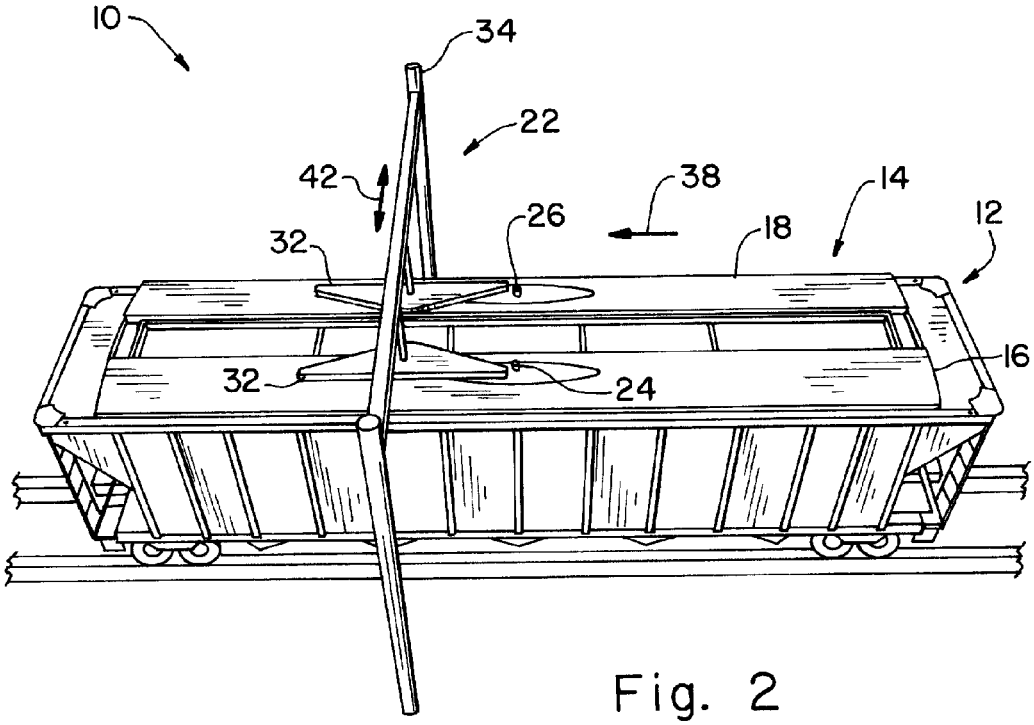
FIG. 2 is another perspective view of the railroad car of FIG. 1 about to encounter the closing device that will act to close the hatches of the railcar.

Referring now to the drawings, and more particularly to FIGS. 1 and 2, there is shown a railcar system 10 including a railcar 12 having a cover system 14 thereon. Cover system 14 includes a hatch 16 and a hatch 18 that encounter an opening system 20 as shown in FIG. 1 and a closing system 22 as shown in FIG. 2. Hatches 16 and 18 respectively have protrusions 24 and 26 extending substantially vertically from the top surface of hatches 16 and 18.

Opening system 20 includes an angled opening wedge 28 that is suspended from an overhead support 30. In a similar fashion, closing system 22 includes closing wedges 32 suspended from an overhead support 34. Railcar 12 has a longitudinal axis 36 and moves along that axis in direction 38. Angled opening wedge 28 has an adjusting direction 40 and in a like manner closing wedge 32 is adjustable in a direction 42.

As railcar 12 moves in moving direction 38 as shown in FIG. 1, protrusions 24 and 26 encounter the angled surfaces of opening wedge 28. Presuming that one of protrusions 24 or 26 encounter opening wedge 28 before the other protrusion, the opening wedge 28 is supported in a sliding manner by overhead support 30, thereby allowing opening wedge 28 to shift in an appropriate direction so as to cause protrusions 24 and 26 to diverge from each other at the same time and cause the opening process to start in a relatively uniform manner. Additionally, there may be a powered adjustment feature with sensors to also adjust wedges 28 and 32 appropriately. Additionally, an adjusting mechanism may be utilized to move wedges 28 and 32 to one side of their prospective support in the event that it is not desired to open the railcars passing beneath supports 30 and 34.

In a typical operation, the movement of the railcars is in a singular direction with railcar 12 first encountering opening system 20 and then, with hatches 16 and 18 in an open position, railcar 12 is loaded with some bulk material. As railcar 12 continues to move in direction 38, it then encounters closing system 22 as shown in FIG. 2 where closing wedge 32 encounters protrusions 24 and 26, adjusting to provide for a uniform closing of hatches 16 and 18. The movement of the wedges in directions 40 and 42 may continue up to the point the hatches 16 and 18 has completed its' travel. This system compensates for any imbalance in the frictional movement of individual hatch. For example, if hatch 16 is reluctant to move, hatch 18 may move to its full extent while hatch 16 is slow to move until hatch 18 reaches its full movement at which point sideways movement stops causing hatch 16 to receive additional force from the encountered wedge causing it then to move to its full extent. Although overhead supports 30 and 34 are illustrated, it is also anticipated that wedges 28 and 32 can be integrated into the structure of a loading operation.

Figure 3:
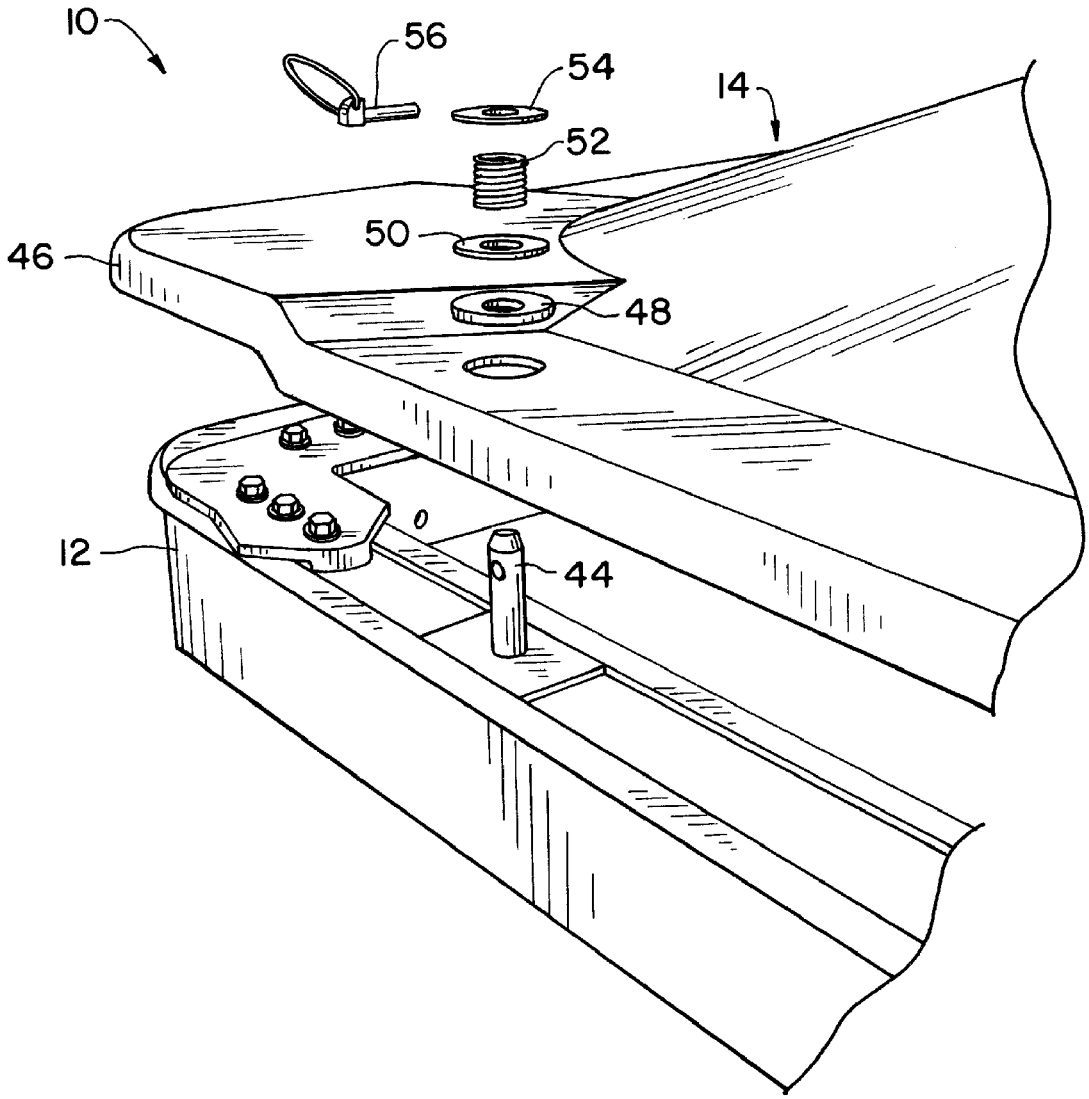
FIG. 3 is an exploded perspective view of one hold down pin system utilized on the cover of FIGS. 1 and 2.

Now, additionally referring to FIG. 3, there is shown part of the cover hold down system including a pin 44 extending from railcar 12 through an opening in cover 46 with a sealing washer 48 followed by a washer 50, a spring 52, a washer 54, and a keeper pin 56. This system advantageously allows for the quick installation and removal of cover system 14. Additionally, positioning of spring 52 allows cover 46 to move upward in the event that there is a sudden air pressure change within railcar 12. Ideally, several of the hold down systems are utilized on cover system 14 at appropriately positioned places.

Figure 4:
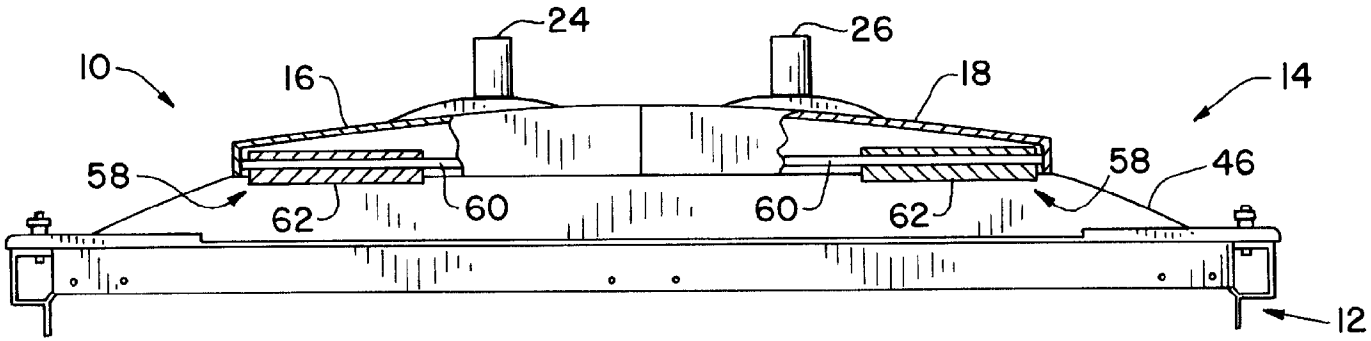
FIG. 4 is a partially sectioned end view of the cover of FIGS. 1-3 showing the hatches in the closed position.
Figure 5:
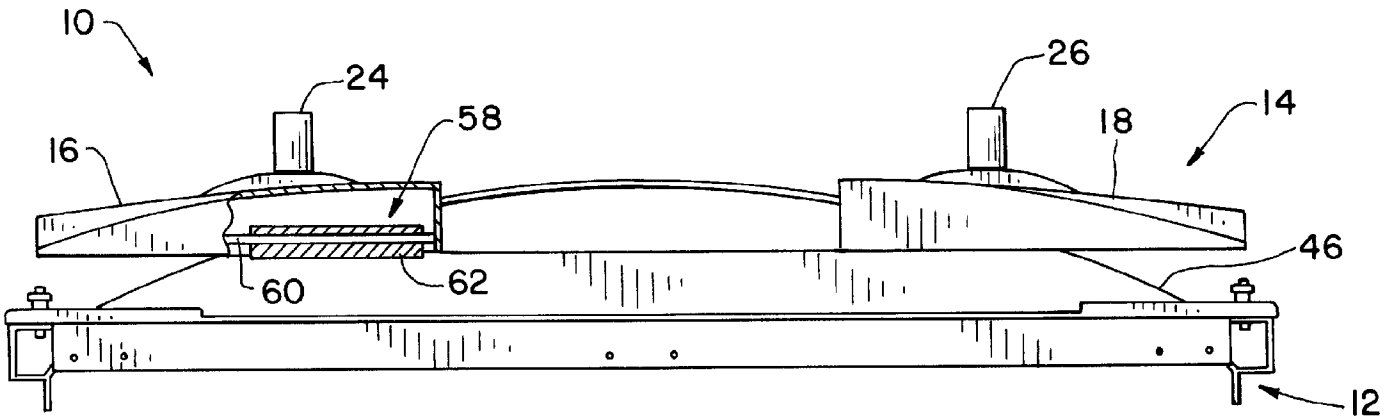
FIG. 5 is a partially sectioned view of the cover of FIGS. 1-4 shown in an open position.

Now, additionally referring to FIGS. 4 and 5, elements of the linear bearings 58, which allow hatches 16 and 18 to move are illustrated. Experimentation has shown that five linear bearings along each hatch are an optimal number of linear bearings for each hatch cover. Other numbers of linear bearings utilized are also contemplated. Linear bearings 58 include a rod 60 that extends through a bearing 62. Rod 60 extends from one edge of the cover to the other edge substantially perpendicular to longitudinal axis 36. Rod 60 may be circular in cross section although other shapes are also contemplated. Bearing 62 has a cavity that is shaped to match the shape of rod 60 and bearing 62 is made of a low friction material to allow rod 60 to slide therethrough. Bearing 62 may be substantially half the length of rod 60 to provide a long bearing surface thereby reducing or eliminating the possibility of hatch 16 or 18 from cocking or pinching while it moves. Bearing 62 is made from a low friction material and has a consistency that has a substantially constant density along its length. Additionally, other configurations are also contemplated such as two bearings 62 separated by a space being positioned to support rod 60. Hatches 16 and 18 are configured to slide toward and away from each other in a coordinated manner by utilizing wedges 28 and 32. However, hatches 16 and 18 are not constrained to open in a coordinated manner. Further hatches 16 and 18 advantageously do not require any mechanism carried by railcar 12 to open or close them. The opening and closing devices, since they are slideable in a direction that is substantially normal to longitudinal axis 36 allows the opening and closing devices to be self-centering relative to protrusions 24 and 26. Opening wedges 28 and closing wedges 32 are stationary relative to the railcar in the longitudinal direction as the railcar passes through opening system 20 and closing system 22.

Figure 6:
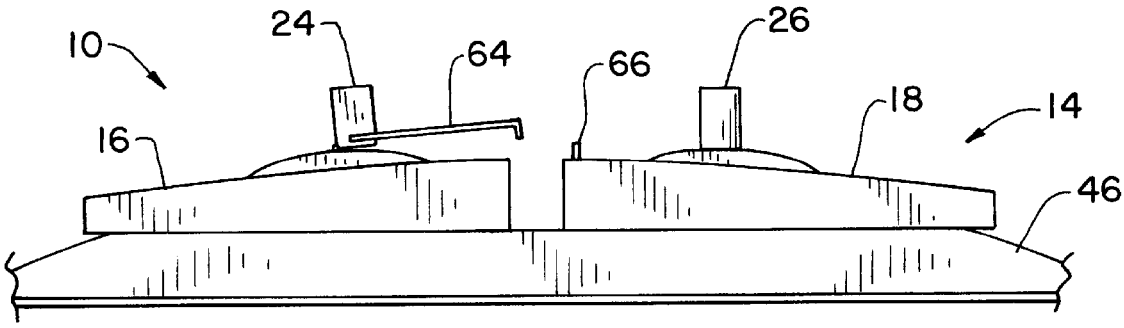
FIG. 6 is a partial end view illustrating an embodiment of a latching mechanism utilized with the cover of FIGS. 1-5.

Now additionally referring to FIG. 6, there is illustrated a hatch latch 64 that is configured to latch hatch 16 to hatch 18 when they are slid together. Opening system 20 also provides for the automatic unlatching of hatches 16 and 18 when the opening sequence starts. The unlatching is illustrated as protrusion 24 is allowed to hinge a predetermined amount to thereby lift latch 64 from catch 66. Closing system 22 in a similar fashion causes the hatch latch to latch before shipping. This is accomplished by latch 64 being itself hinged relative to protrusion 24 having a wedge shaped end that encounters catch 66 to thereby allow latch 64 to hook to catch 66. Other latching mechanisms are contemplated including magnetic latches.

While the opening and closing of hatches 16 and 18 has been discussed relative to a filling operation, it is also anticipated that hatches 16 and 18 will be at least partially opened during an emptying operation to preclude any damage that might occur by the rapid removal of bulk material which may cause a vacuum within railcar 12. Alternatively, a pressure relief valve system may be part of cover system 14. For example, a pressure relief valve may be an integral part of protrusions 24 and 26 extending through the middle thereof.

Now, additionally referring to FIGS. 7-11, there is shown an opening system 110 and a closing system 112, which are further embodiments to those illustrated in FIGS. 1 and 2. Opening systems 110 and closing systems 112 each include a supporting structure 114 having a vertical support 116 and horizontal rails 118. The carriage 120 is moveable along horizontal rails 118 and carriage 120 includes an outer frame 122 and an inner frame 124. Inner frame 124 is related to outer frame 122 by way of a bias centering feature 126. Bias centering feature 126 includes rods 128 and springs 130. Connected to inner frame 124 of opening system 112 is opening wedge 132, also referred to as an opening device 132. Attached to inner frame 124 of closing system 112 is closing wedges 132, also referred to as a funnel 134, or a closing device 134.

The references to elements 114 through 130 are designated with the same numbers in both opening system 110 and closing system 112, although these two structures are separate. The use of the same numbers is for the sake of clarity and to illustrate that parts would be interchangeable to the point of the orientation of the wedge features specifically associated with either opening system 110 or closing system 112.

As railcar 12 moves in direction 38, it first encounters opening system 110 that serves to open covers 16 and 18 in a direction that is substantially normal to axis 36. Between opening system 110 and closing system 112 is positioned a device to fill and/or empty railcar 12, which is not illustrated. The filling or emptying device that is positioned between opening system 110 and closing system 112 is conveniently located so that covers 16 and 18 are opened for the filling or emptying process. As railcar 12 moves in direction 38 after being filled or emptied, railcar 12 encounters closing system 112, where closing wedges 134 contact protrusions 24 and 26 to thereby close covers 16 and 18 in a sliding manner.

Since there is some variation in the positioning of protrusions 24 and 26 based on the installation of cover systems 14 and to adjust to the overall tolerances of the railcar structure, inner frame 124 can move along rods 28 relative to outer frame 122 to self-compensate for some misalignment so that opening devices 132 and closing devices 134 can open/close covers 16 and 18 in a generally equal manner, causing covers 16 and 18 to move in opposite directions when encountering wedges 132 and/or 134. It may be noted that wedges 132 and 134 may, in fact, be identical and perform either the opening or closing function based on their orientation on inner frame 124.

Figure 7:
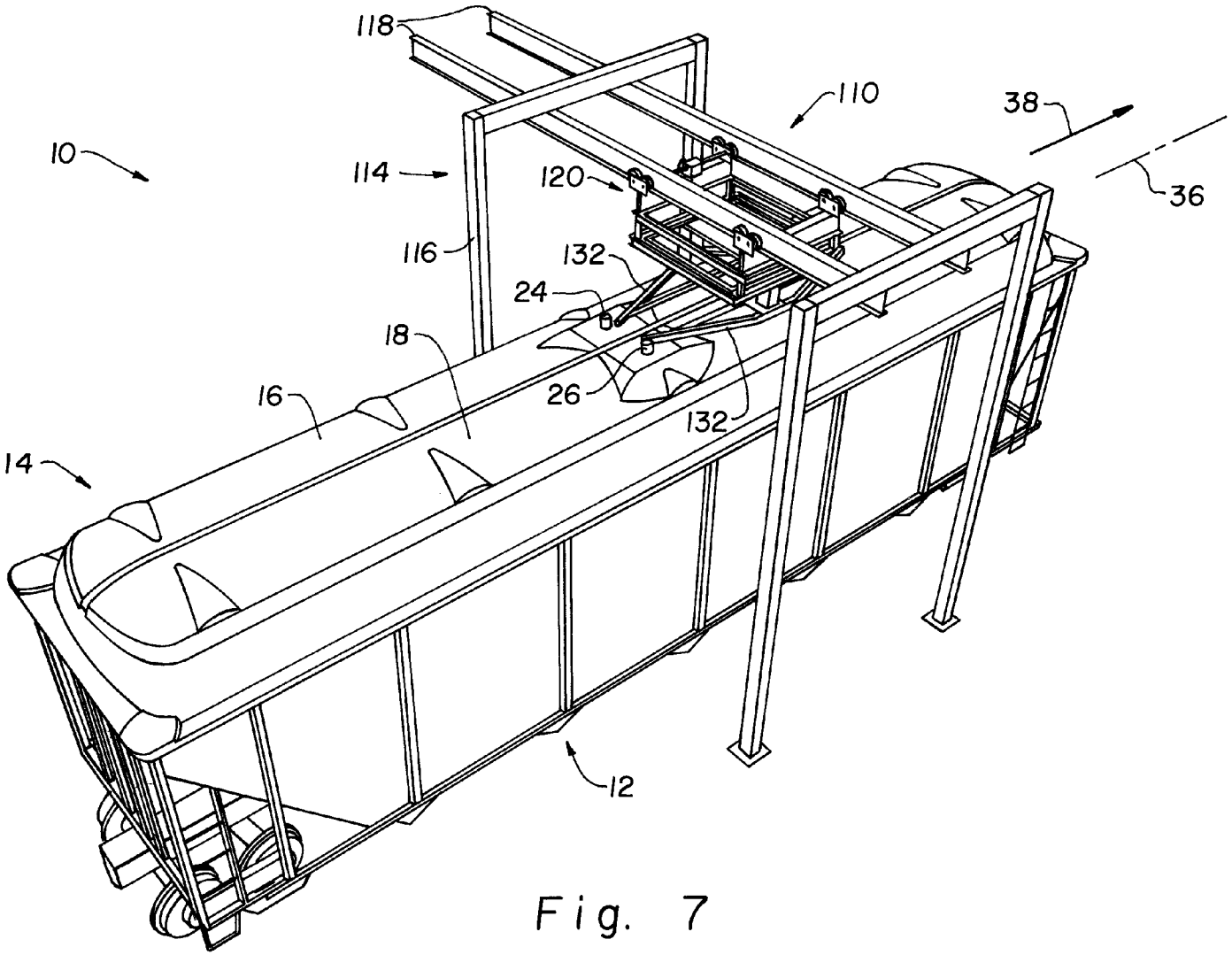
FIG. 7 is a perspective view of a railcar having a railcar cover with an embodiment of an opening device of the present invention suspended thereover.
Figure 8:
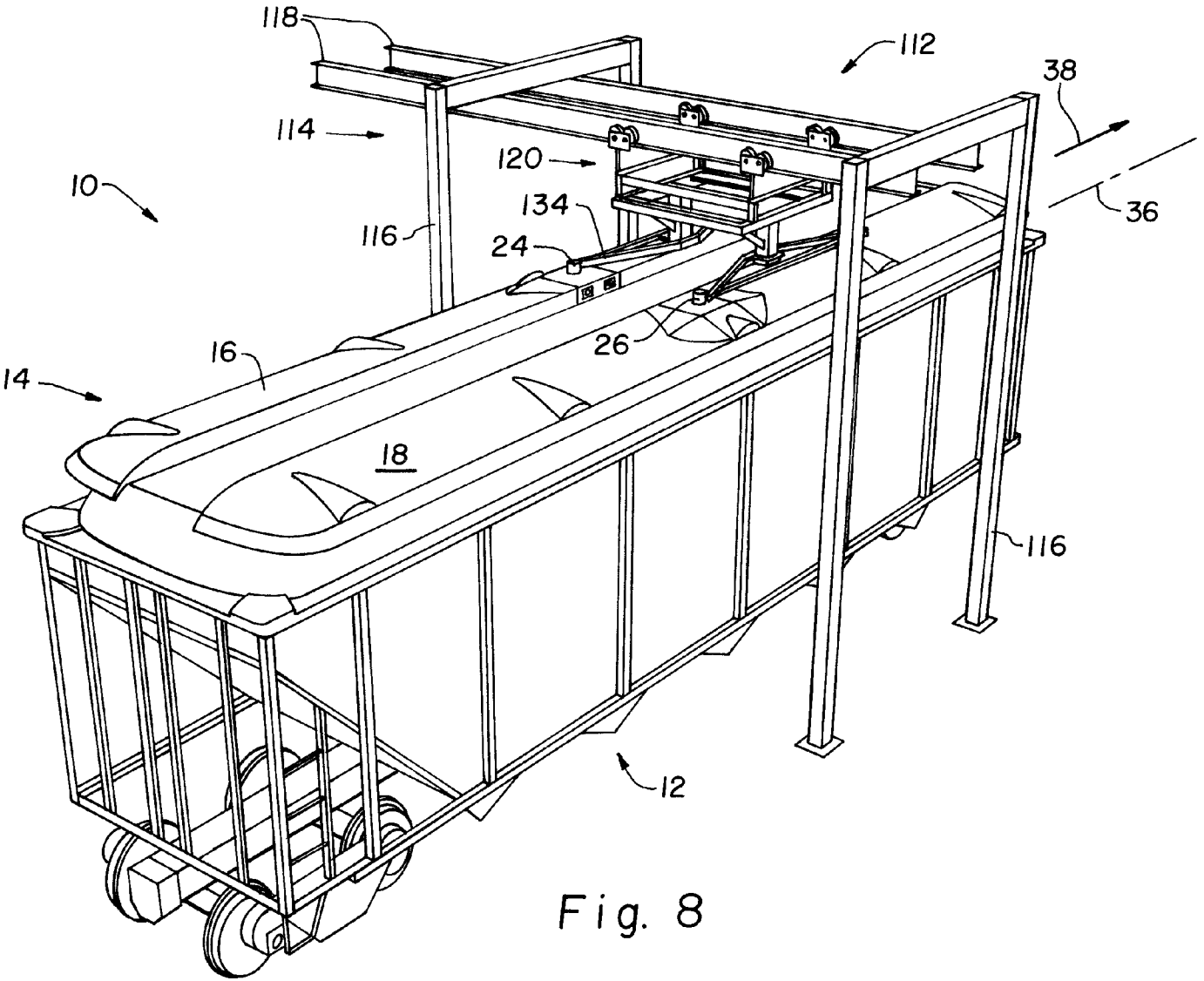
FIG. 8 is a perspective view of the railcar of FIG. 7 with an embodiment of an closing device of the present invention suspended thereover.
Figure 9:
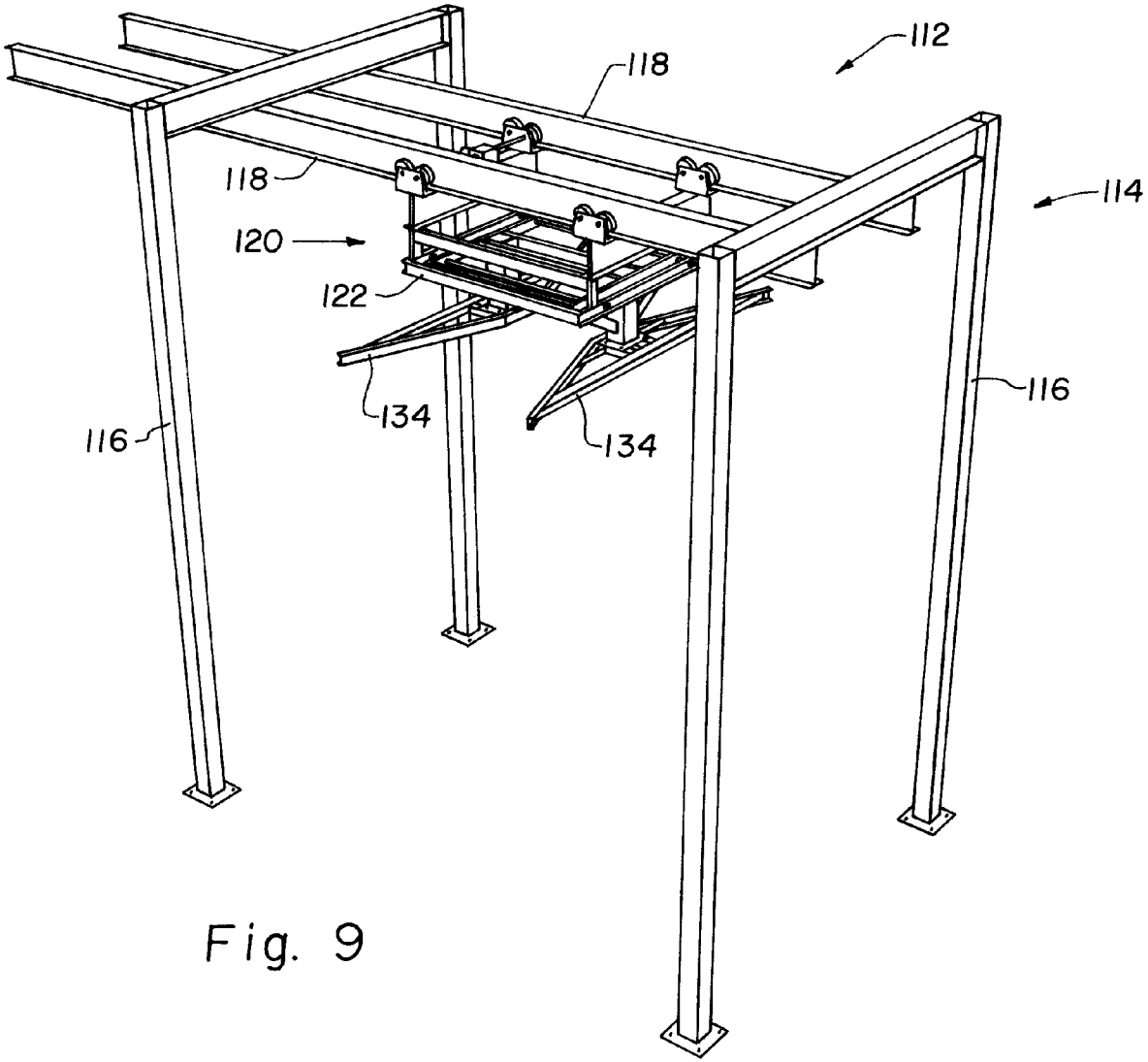
FIG. 9 is a perspective view of the closing device of FIG. 8.

As can be seen in FIGS. 7-9, horizontal rails 118 extend beyond vertical supports 116 in at least one direction, allowing carriage 120 to move away from the path of railcars 12 to allow the collection of railcars, such as the engine, which may be taller than railcars 12 to not encounter wedges 132 and 134. This advantageously allows for the passage, as well as maintenance activities, to be done safely away from the path of a train. Further, there is a driving mechanism on carriage 120 most easily seen in FIG. 10, where a motor under control of a control system, not illustrated, can be used to position carriage 120 and provides adjustment in a horizontal direction for wedges 132 or 134. Further, the control system may cause wedges 132 and 134 to move in a vertical direction to compensate for different heights of railcars 12. Protrusions 24 and 26 may be rollers that roll along the surface of wedges 132 and 134 or they may slide along the surfaces of wedges 132 and 134 that they encounter. The symmetry of wedges 132 and 134 allow for easy interchangeability of components.

Figure 10:
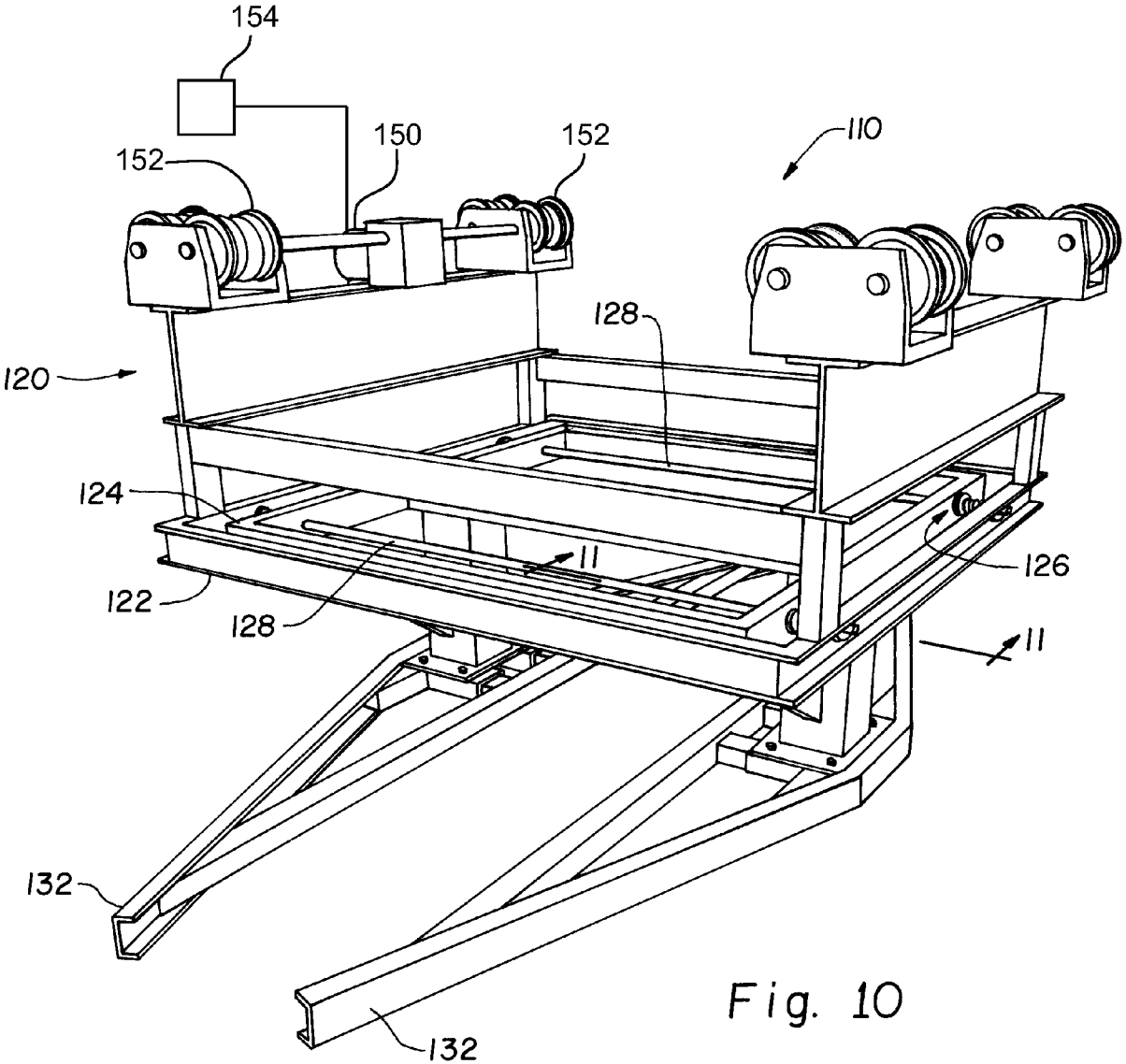
FIG. 10 is a perspective view of the opening device of FIG. 7.
Figure 11:
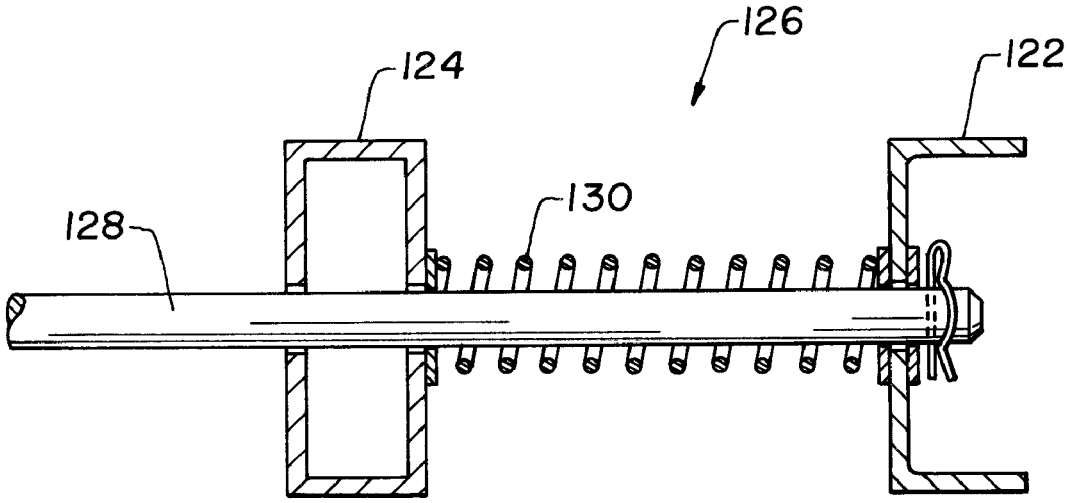
FIG. 11 is a partial cross-sectional view taken along 11-11 of FIG. 10, illustrating a self centering feature of the present invention.

As seen in FIGS. 10 and 11, inner frame 124 and outer frame 122 have biased centering features 126 associated between the sides thereof. Biased centering features 126 allows inner frame 124 to move along rods 128 to help self-center wedges 132 or 134 as they encounter protrusions 24 and 26. Springs 30 provide for a general centering of inner frame 124 relative to outer frame 122.

The present invention has certain advantages in that the opening of car covers on a railcar can occur without the application of any power source to the railcar and it can happen in a relatively unassisted manner so that the railcars remain closed until just prior to the filling or emptying operation and then are promptly closed after the filling and/or emptying operation to thereby provide a minimal amount of time for exposure of the cargo and/or the interior of railcar 12 to wind, moisture, and solar radiation. A further advantage of the present invention is that the self-centering assists in the proper opening or closing to ensure that covers 16 and 18 travel substantially the same distance in their meeting and separating actions.

In another embodiment of the present invention, as shown in FIG. 10, there is a motor 150 that drives wheels 152 to position carriage 120, under the control of controller 154 shown in an abstract manner. Controller 154, may be a mechanical, pneumatic, hydraulic, electrical, electronic controller or a combination of these technologies. Controller 154 positions carriage 120 on rails 118 by issuing instructions to motor 150, or by the supplying of some power to motor 150. Motor 150 may be an electric motor, a hydraulic motor or a pneumatic motor, operating under the control of controller 154. There may be a separate controller 154 for each of opening system 110 and closing system 112, or one controller 154 may control carriages 120 of both opening system 110 and closing system 112

During an opening/closing operation controller 154 positions carriage 120 in an aligning position relative to axis 36. While doors 16 and 18 are moving, if the movement is somehow restricted in one of the doors, carriage 120 may move freely with controller 154 monitoring the position, or carriage 120 may move under the direction of controller 154 based on sensed pressure on wedges 132 and 134, which are a result of encountering protrusions 24 and 26. If carriage 120 is free to move controller 154 may brake the movement after moving a predetermined distance, such as 6 inches. Once railcar 12 has moved such that protrusions 24 and 26 are free of wedges 132 or 134, controller 154 causes carriage 120 to substantially realign itself with axis 36. The passing of railcar 12 may be detected with a sensor that monitors the position of railcar 12 or by way of sensors the monitor the position of protrusions 24 and 26, or by way of load sensors that detect a load on wedges 132 and 134.

Controller 154 can also cause the movement of carriage 120 to locate it on the portion of rails 118 away from the railroad track which supporting structure 114 spans. Controller 154 may be connected to sensors (not shown) that detect the height of the railcars and to then move carriage 120 away from the railroad track when a higher railcar is approaching supporting structure 114, to thereby preclude contact with an unintended object.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A railcar system, comprising:

a railcar having a longitudinal axis, said railcar having a top opening;

at least one movable cover configured to cover said opening;

at least one structural support coupled generally to the ground; and at least one of an opening device and a closing device coupled to said at least one structural support, said at least one of an opening device and a closing device configured to contact a portion of said movable cover and to cause said movable cover to move as said railcar moves in a longitudinal direction substantially parallel with said longitudinal axis, said at least one movable cover being movable in a direction substantially normal to said longitudinal direction, said at least one movable cover includes a first movable cover and a second movable cover which move in opposite directions to each other when said portion of said movable covers are contacted with one of said opening device and said closing device.

2. The railcar system of claim 1, wherein said opening device contacts said portion of said first movable cover and said portion of said second movable cover at approximately a same time when said railcar is traveling in said longitudinal direction.

3. The railcar system of claim 1, wherein each of said portions of said movable covers are a protrusion that extends generally above a top surface of said movable covers.

4. The railcar system of claim 3, wherein said opening device is configured to shift in a direction substantially normal to said longitudinal direction when said opening device encounters one of said protrusions on one of said movable covers before encountering the other of said protrusions on an other of said movable covers.

5. The railcar system of claim 3, wherein said opening device is aligned to be substantially between said protrusions to thereby open said first movable cover and said second movable cover as said railcar moves relative to said opening device, said closing device being configured to contact said protrusions to close said first movable cover and said second movable cover as said railcar system moves relative to said closing device.

6. The railcar system of claim 3, wherein at least one of said opening device and said closing device is slidable in a direction substantially normal to said longitudinal axis thereby being configured to self center relative to said protrusions.

7. The railcar system of claim 6, wherein said opening device and said closing device do not substantially move in said longitudinal direction.

8. The railcar system of claim 1, wherein said at least one structural support includes a first structural support connected to said opening device and a second structural support connected to said closing device, said second structural support being positioned in said longitudinal direction from said first structural support.

9. A railcar system, comprising:

a railcar having a longitudinal axis, said railcar having a top opening;

at least one movable cover configured to cover said opening;

at least one structural support coupled generally to the ground; and at least one of an opening device and a closing device coupled to said at least one structural support, said at least one of an opening device and a closing device configured to contact a portion of said movable cover and to cause said movable cover to move as said railcar moves in a longitudinal direction substantially parallel with said longitudinal axis, wherein both said opening device and said closing device have surfaces configured to contact portions of the at least one movable cover, said surfaces being substantially symmetrical about said longitudinal axis.

10. A cover opening and closing system for use with a railcar having a longitudinal axis, a top opening and at least one movable cover configured to cover the opening, the system comprising:

at least one structural support coupled generally to the ground; and at least one of an opening device and a closing device coupled to said at least one structural support, said at least one of an opening device and a closing device configured to contact a portion of the at least one movable cover and to cause said movable cover to move as said railcar moves in a longitudinal direction substantially parallel with said longitudinal axis, wherein the at least one movable cover moves in a direction substantially normal to said longitudinal direction, the at least one movable cover includes a first movable cover and a second movable cover which move in opposite directions to each other when said portion of the movable covers are contacted with one of said opening device and said closing device.

11. The cover opening and closing system of claim 10, wherein said opening device contacts said portion of the first movable cover and said portion of the second movable cover at approximately a same time when the railcar is traveling in the longitudinal direction.

12. The cover opening and closing system of claim 10, wherein each of said portions of said movable covers are a protrusion that extends generally above a top surface of the movable covers.

13. The cover opening and closing system of claim 12, wherein said opening device is configured to shift in a direction substantially normal to said longitudinal direction when said opening device encounters one of said protrusions on one of the movable covers before encountering the other of said protrusions on an other of the movable covers.

14. The cover opening and closing system of claim 12, wherein at least one of said opening device and said closing device is slidable in a direction substantially normal to said longitudinal axis thereby being configured to self center relative to said protrusions.

15. The cover opening and closing system of claim 14, wherein said opening device and said closing device do not substantially move in said longitudinal direction.

16. A cover opening and closing system for use with a railcar having a longitudinal axis, a top opening and at least one movable cover configured to cover the opening, the system comprising:

at least one structural support coupled generally to the ground; and at least one of an opening device and a closing device coupled to said at least one structural support, said at least one of an opening device and a closing device configured to contact a portion of the at least one movable cover and to cause said movable cover to move as said railcar moves in a longitudinal direction substantially parallel with said longitudinal axis, wherein both said opening device and said closing device have surfaces configured to contact portions of the at least one movable cover, said surfaces being substantially symmetrical about said longitudinal axis.

* * * * *